US006896042B2

(12) United States Patent
Inoue et al.

(10) Patent No.: US 6,896,042 B2
(45) Date of Patent: May 24, 2005

(54) STRUCTURE OF PIPE PLATE UNIT FOR HEAT EXCHANGERS AND METHOD OF REPLACEMENT FOR THE PIPE PLATE UNIT

(75) Inventors: Koichi Inoue, Takasago (JP); Teruaki Sakata, Takasago (JP); Satoshi Hiraoka, Takasago (JP); Hiroji Nakamae, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/360,855

(22) Filed: Feb. 10, 2003

(65) Prior Publication Data

US 2003/0164232 A1 Sep. 4, 2003

(30) Foreign Application Priority Data

Feb. 14, 2002 (JP) ..... 2002-037417

(51) Int. Cl.[7] ..... F28F 9/02
(52) U.S. Cl. ..... 165/145; 165/178
(58) Field of Search ..... 165/145, 158, 165/178, 82

(56) References Cited

U.S. PATENT DOCUMENTS 1,757,327 A * 5/1930 Mosher ..... 165/82
1,780,294 A * 11/1930 Davis, Jr. ..... 165/82
2,101,782 A * 12/1937 Kuhner ..... 165/149
2,487,626 A * 11/1949 Wittman ..... 165/82
2,869,834 A * 1/1959 Clark, Jr. et al. ..... 165/158
3,805,745 A * 4/1974 Block et al. ..... 122/367.3
4,253,516 A * 3/1981 Giardina ..... 165/78
4,592,416 A * 6/1986 Mattison et al. ..... 165/83

FOREIGN PATENT DOCUMENTS

JP 61-39277 3/1986

OTHER PUBLICATIONS

C. Harrington, et al., Surface Condenser Design, Installation, and Operating Experience, pp. 93–100, "Comanche Peak Bundle Replacement Before Operation: Main Condenser; Auxiliary Condenser; Moisture Separator Reheater", Copyright 1987 by The American Society of Mechanical Engineers.

* cited by examiner

*Primary Examiner*—Allen Flanigan
(74) *Attorney, Agent, or Firm*—Oblon, Spivak, McClelland, Maier & Neustadt, P.C.

(57) ABSTRACT

The present invention relates to the structure of a pipe plate unit for heat exchangers which may be employed in condensers, etc. that is used in thermoelectric and nuclear power plants. The object of this invention is to provide a structure for heat exchanger pipe plate units which reduces the number of construction steps and the labor costs for replacement of the pipe plate units, and which results in a pipe plate unit for heat exchangers after the replacement process that maintains a good seal for the fluids and which is adequately strong. The pipe plate unit for heat exchangers in which a plurality of heat conducting pipes are attached by welding at both ends to two opposing pipe plates, each bounded on one side by a fluid chamber, wherein the structure of the pipe plate unit for heat exchangers comprises a plurality of subassembly units to be assembled vertically and attached together, the plurality of subassembly units divide the pipe plate unit on the horizontal plane in a direction perpendicular to the surfaces of the pipe plates.

7 Claims, 7 Drawing Sheets

3 Faceplate
2 Steel plate
Pipe plate 1
5 Pipe support plate

Z
1
100
Subassembly unit
7
Junction area
1
100
A
A
4
4
07
4
Heat conducting pipe
6
Reinforcing pipe
100
100
4

STRUCTURE OF PIPE PLATE UNIT FOR HEAT EXCHANGERS AND METHOD OF REPLACEMENT FOR THE PIPE PLATE UNIT

BACKGROUND OF THE INVENTION

1. Field of the Invention

The present invention relates to the structure of a pipe plate unit for heat exchangers and the method of replacement for said the pipe plate unit, which is comprised of a fluid chamber formed on one side of each of two pipe plates, and a plurality of heat conducting pipes affixed by welding to both edges of said pipe plates, wherein such heat exchangers may be employed in condensers, etc. that used in thermoelectric and nuclear power plants.

2. Description of the Related Arts

FIG. 8 shows a diagram of the principal structure of a condenser 200 such as was conventionally used in thermoelectric and nuclear power plants. In the figure, 203 represents a condenser casing, 206 a condensation chamber in the below described pipe plate unit, and 202 a water chamber with and inlet/outlet for sea water. 201 represents a pipe plate unit comprising two pipe plates 1, 1, one side of each bordering the foregoing water chambers 202, with a plurality of heat conducting pipes 4 being affixed by welding thereto. 5 is a pipe support plate supporting a plurality of said heat conduction pipes 4.

In condensers of the prior art, the heat conducting pipes made from titanium materials were proposed for use as the foregoing heat conducting pipes.

In these pipe plate units 201 equipped with the titanium heat conducting pipes 4, the pipe plates 1 were commonly made from carbon steel materials or the like in order to hold down the cost of materials, to which a surface plate (faceplate) of titanium materials was affixed by explosive cladding, etc. This material is called clad steel plate.

In such condenser for conventional thermoelectric or nuclear power plants shown in FIG. 8, when the heat conducting pipes 4 wore out as the plant facilities aged, if the heat conducting pipes 4 that performed the heat exchange, pipe plates 1 and pipe support plates 5, were to be manufactured as a pipe plate unit 201 in a factory and be replaced as a single module, it would be possible to reduce construction time as well as costs.

However, due to the structure of condenser 200, when replacing pipe plate unit 201, it would be necessary to install pipe plate unit 201 from the side of condenser 200.

But as is shown in FIG. 8, since the condenser 200 is normally installed just beneath a low pressure turbine, all or the majority of pipe plate units 201 are located beneath the floor 204 of the plant.

Thus, because pipe plate unit 201 has a large number of heat conducting pipes 4 welded to its pipe plates 1, because of the three dimensional assembly of said pipe plate unit 201, and because all or most of pipe plate unit 201 would lie beneath the foregoing plant floor 204 level, interference by the foundation 205 with pipe plate unit 201 made it impossible to install said pipe plate unit 201 into condenser 200 in a fully assembled form.

Due to this problem, the conventional solution did not use a factory module, but rather, the parts required for the replacement, such as the pipe support plates 5 and the pipe plates 1 would be placed inside of the condenser casing 203 on site, and then heat conducting pipes 4 would be inserted one by one through pipe plates 1 and pipe support plates 5, and subsequently be welded to pipe plates 1. Accordingly, this conventional means, further hampered by the poor working environment on site, required a great many construction steps to swap out heat conducting pipes 4 and the other parts of pipe plate unit 201, and the costs for these replacement operations were high.

Also, prior to the present invention, the preceding technology shown in FIGS. 9 and 10 were disclosed in Japan Patent Publication 2001-201271.

As is shown in FIGS. 9 and 10, the condenser in the preceding technology, installed in nuclear power plants, etc., was comprised of a unit casing 301 that retained a pipe plate holding a large number of small, pipe-shaped cooling tubes. Said unit casing 301 was an assembly consisting of the water chamber bodies 306*a*, 306*b*, the water chamber covers 307*a*, 307*b* which comprised the input side water chamber 308*a*, and the outlet side water chamber 308*a* was sandwiched between pipe plates. At the lower edge of the foregoing input side water chamber 308*a* was installed a coolant inlet seat 311*a*, while coolant inset seat 311*b* was installed at the lower edge of outlet side water chamber 308*a*.

Accordingly, as shown in FIGS. 9 and 10 the pipe bundles that are attached inside of the condenser unit casing 301 in a manner such that a plurality of the pipe bundle units run parallel to the flow of steam S. In other words, the plurality of short pipe bundle units 323 (or as shown in FIG. 10, 323*a*) run parallel to steam flow along the plate surface of connection plate 325.

Thus, in this preceding technology, since the ends of coolant pipes 302 are affixed to connection plate 325, these unitized pipe bundles 323 or 323*a* can be separately attached inside of the casing 1, and further, since the other end of the foregoing unit pipe bundles 323 or 323*a* is attached to pipe plates 324, there are solidly affixed on the side next to the water chambers 308*a* and 308*b*.

With this technology, if there are any obstacles inside the structure in which the units are transported or any restrictions upon the openings through which they are transported, there remains enough space to withdraw the coolant pipes 2, and even in difficult installations such as condensers, they are easily pulled out and replaced to shorten the time required for the construction operation.

Moreover, as shown in the foregoing FIG. 8, when pipe plate units 201 which includes heat conducting pipes 4 are installed beneath the lower pressure turbine in a condenser, all or most of the pipe units lie below the floor grade 204 of the plant.

At this point, preceding technology disclosed in Japan Patent Publication 2001-201272, as shown in FIGS. 9 and 10, individually install a plurality of pipe bundle units 323 or 323*a* inside the condenser casing in a direction parallel to the flow of steam S, but although each of the pipe bundle units 323 or 323*a* needs to be moved in the direction of steam S flow, in other words in the vertical direction, for their installation or removal, it is not possible to move pipe bundles 323 or 323*a* in the horizontal direction. Thus in swapping out the pipe plate units, the entire condenser must be lifted up to clear the interference from the foundation 205 to perform the exchange. Accordingly, this technique also involves a great many construction steps to complete the exchange of the pipe plate units, and those operations are costly.

SUMMARY OF THE INVENTION

The present invention was developed after reflecting upon the problems associated with the prior art and its objective is, with regard to heat exchanger pipe plate units having a plurality of heat conducting pipes welded to a pair of pipe plates, to provide a structure for heat exchanger pipe plate units and a method of their replacement which reduces the number of construction steps and the labor costs for replacement of said pipe plate units and which results in a pipe plate unit for heat exchangers after the replacement process that maintains a good seal for the fluids and which is adequately strong.

In order to achieve the objective mentioned above, this invention discloses a pipe plate unit for heat exchangers in which a plurality of heat conducting pipes are attached by welding at both ends to two opposing pipe plates, each bounded on one side by a fluid chamber, wherein the structure of said pipe plate unit for heat exchangers comprises a plurality of subassembly units to be assembled vertically and attached together, said plurality of subassembly units divide said pipe plate unit on the horizontal plane in a direction perpendicular to the surfaces of said pipe plates.

For replacing the pipe plate unit for heat exchangers in which a plurality of heat conducting pipes are attached by welding at both ends to two opposing pipe plates, each bounded on one side by a fluid chamber, said method, comprises the steps of: dividing said pipe plate unit into a plurality of subassembly units on the horizontal plane in a direction perpendicular to the surfaces of said pipe plates; and assembling said plurality of subassembly units successively to install said pipe plate unit. The plurality of subassembly units will be then connected successively. With this configuration, the pipe plate unit will be easily replaced.

According to this invention, when assembling the foregoing plurality of subassembly units as replacements into an existing condenser, the foregoing two sets of subassembly units are fabricated in a factory, the subassembly units are then transported to the plant where they are to be installed, and then the subassembly units are attached together vertically in a manner to make them fluid-tight and adequately strong to thereby complete the swapping out of the pipe plate unit.

In this replacement operation, since the foregoing pipe plate unit is divided into a plurality of subassembly units along a horizontal plane that is perpendicular to pipe plates, and further, since the subassembly units are installed in succession, in (heat exchanger) installations found in condensers for thermoelectric or nuclear power plants, which lie below the floor grade, even in cases where it would be difficult to install the entire pipe plate unit in an assembled form, it can be divided into these appropriately sized subassembly units that can easily be moved horizontally and assembled in the device.

The above described structure eliminates the requirements imposed by the conventional technology when swapping out the pipe plate unit of acquiring all of the necessary parts on site in which the working environment is poor, inserting each of the heat conducting pipes and welding them in place; as well as the need when replacing the pipe plate unit, of lifting the entire condenser to a position that avoids the interference by the foundation with the pipe plate unit, and then replacing the unit. It not only simplifies the operation of replacing pipe plate units, but also requires but few steps in performing the replacement.

This invention improved the connecting structure in the pipe plate unit. The pipe plate comprises a clad steel plate which comprises a steel plate and a faceplate cladding of titanium plate bordering said fluid chamber, and a connecting plate at a connection area of said subassembly units is provided on the side opposite the faceplate side, said connecting plate connects said adjacent subassembly units by the bolts, and further, the bolt insertion area including the heads of said bolts are covered by a cover plate, and the perimeter of said cover plate is seal welded to said faceplate.

According to this configuration, the subassembly units are strongly joined together by bolts holding connecting plate against the heat conducting pipe side to span across the adjacent subassembly units to thereby improve the flexure strength of the junction area. Further since the only seal welding was performed at the installation site of the foregoing condenser, there is almost none of the deformation or reduced strength that commonly results form welding.

Further, the seal welding was performed around cover plate that covers the head area of bolts assures that no leakage will occur at the foregoing junction area.

Since both the heat conducting pipes and faceplates are comprised of titanium materials, it is possible to weld the foregoing titanium cover plate to faceplate to avoid any possibility of galvanic corrosion between the titanium materials and steel plate.

Further, in this invention, the pipe plate comprises a clad steel plate which comprises a steel plate and a faceplate cladding of titanium plate bordering said fluid chamber, a pair of connecting plates at a connection area of said subassembly units are provided on both sides of said pipe plate, said pair of connecting plates sandwich said adjacent subassembly units and connect by the bolts which penetrate said subassembly units and said connecting plates, and further, the bolt insertion area including the heads of said bolts on the water chamber side, said bolts, and said faceplate cladding of titanium plate bordering said fluid chamber are seal welded to each other.

According to the present configuration, the foregoing connecting plates sandwich pipe plates of the adjacent subassembly units to hold them together, and bolts firmly attach connecting plates to the pipe plates of the adjacent subassembly units to improve the flexure strength of the subassembly units at their junction.

Further, in this invention, the pipe plate comprises a clad steel plate which comprises a steel plate and a faceplate cladding of titanium plate bordering said fluid chamber, the connection area between said adjacent subassembly units, has a certain length of said faceplate removed from the connecting surface of said adjacent subassembly units as well as a flange protruding from said areas where the surface faceplates are removed from said pipe plates, said flanges are fastened together with bolts for connecting said adjacent subassembly units, and seal welding is performed around the flange junctions and around areas where the bolts are inserted.

In this configuration, a filler made from non-metallic materials is preferably applied to cover the outside areas of said flange and bolt, and the outside circumference of said filler is further covered by a lining made from a non-metallic membrane material.

Further, in this invention, the pipe plate comprises a clad steel plate which comprises a steel plate and a faceplate cladding of titanium plate bordering said fluid chamber, a first connecting plate at a connection area of said subassembly units is provided on the side opposite the faceplate for said pipe plate, said first connecting plate connects said adjacent subassembly units by one of compound screw bolts, and further, a second connecting plate covered by a lining made form a non-metallic membrane material on the faceplate side connects said adjacent subassembly units by said compound screw bolts and nuts (button head nuts).

In this configuration, a filler made from non-metallic materials is preferably applied to cover the outside areas of said second connecting plate provided on the faceplate side and the outer side of said compound screw bolts, and the outside circumference of said filler is further covered by a lining made form a non-metallic membrane material.

In the present configuration, flanges project at junction area for the subassembly units, and bolt securely holds said flanges together to afford increased flexure strength to junction area of subassembly units, as well as strongly joining said subassembly units together. Seal welding is also performed at the foregoing flange junction and around the bolt in order to make them fluid tight to positively prevent fluid leakage at the foregoing junction area.

Further, a non-metallic filler material is put in place around the foregoing flange and bolt with its outside circumference covered by lining material to completely isolate subassembly unit 100 from the sea water inside water chamber, and to prevent corrosion in the vicinity of junction area.

Further, in this invention, the pipe plate comprises a clad steel plate which comprises a steel plate and a faceplate cladding of titanium plate bordering said fluid chamber, a first connecting plate at a connection area of said subassembly units is provided on the heat conducting pipe side of said pipe plates, said first connecting plate connects said adjacent subassembly units by the first bolts, and further, a second connecting plate at a connection area of said subassembly units is provided on the faceplate side of said pipe plates, said second connecting plate connects said adjacent subassembly units by the second bolts via gaskets. Further a space is created between said adjacent subassembly units, and said space is filled with a filler made from non-metallic materials.

In this configuration, in addition to having bolts attach connecting plate, which spans subassembly units, to subassembly units on the heat conducting pipe side, a reinforcing plate that spans the subassembly units is attached on the faceplate side, in a manner such that the subassembly units are attached to a reinforcing plate on the and by connecting plate on the heat conducting pipe side by means of independent bolt sets, which greatly improves the strength of junction area as well as improving its flexure strength.

Further, the attachment surfaces between reinforcing plate and subassembly units being each covered by gaskets serves to further improve the fluid seal at junction area and assuredly protect against leakage from junction.

DETAILED DESCRIPTION OF THE PREFERRED EMBODIMENTS

Figures 1A, 1B:
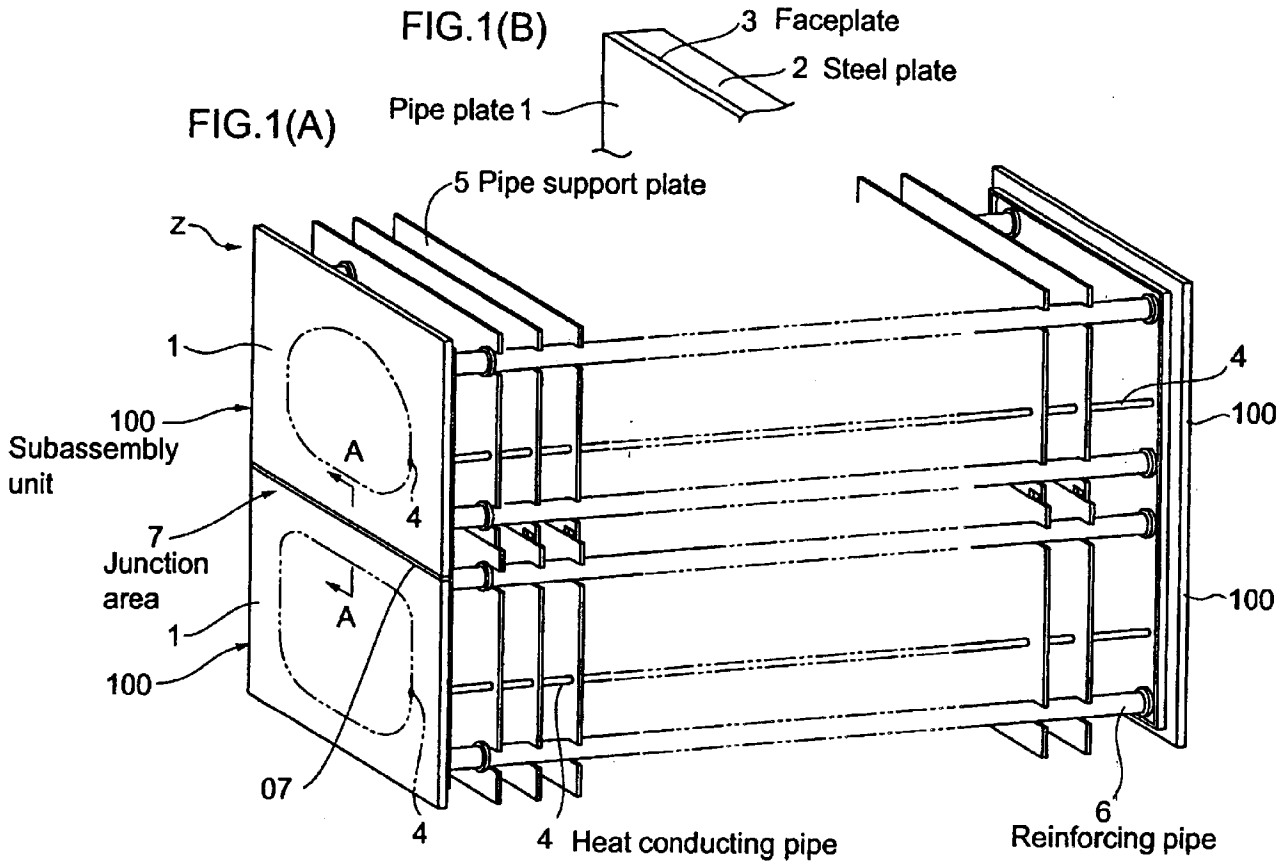
FIGS. 1 (A) and (B) show a perspective view of an embodiment of the structure of a pipe plate unit for condensers according to this invention, which are used in thermoelectric or nuclear power plants.

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

FIGS. 1 (A) and (B) show a perspective view of an embodiment of the structure of a pipe plate unit for condensers according to this invention, which are used in thermoelectric or nuclear power plants. FIG. 2 is a sectional view (taken along line A—A of FIG. 1) of the primary parts of a of the connecting area of a first embodiment of a subassembly unit. FIG. 3, which corresponds to FIG. 2, shows a second embodiment of the connecting area of a subassembly unit. FIG. 4, which corresponds to FIG. 2, shows a third embodiment of the connecting area of a subassembly unit. FIG. 5, which corresponds to FIG. 2, shows a fourth embodiment of the connecting area of a subassembly unit. FIG. 6, which corresponds to FIG. 2, shows a fifth embodiment of the connecting area of a subassembly unit. FIG. 7 shows a side view of a condenser for a thermoelectric or nuclear power plant which employs the present invention.

In FIG. 7, which is a diagram of a condenser for a thermoelectric or nuclear power plant that includes the present invention, 203 represents a condenser casing and 202 is a water chamber having the inlet/outlet for the coolant which is sea water. 201 is a pipe plate unit, which, as will be described below, is comprised of a plurality of subassembly units 100 (three of them in the example shown in FIG. 7). The structure is such that a plurality of heat conducting pipes 4 are attached by welding to one side of each of two pipe plates 1, 1, which contain the foregoing water chambers 202. 5 represents the pipe support plate that supports the aforementioned plurality of heat conducting pipes 4.

In this condenser, steam from the low pressure turbine (not shown) is introduced into steam condensation chamber 206, and as it flows between the numerous heat conducting pipes 4 that comprise pipe plate unit 201, the sea water functioning as coolant sent from water chamber 202 flows inside said heat conducting pipes 4 toward the water supply side by means of the condenser pump (not shown).

The present invention relates to the structure of the pipe plate unit used in the heat exchange of said condenser, and to the method of replacing said pipe plate unit.

An embodiment of the foregoing pipe plate unit 201 is shown in FIG. 1, wherein 1 represents a pair of pipe plates and 4 is a plurality of heat conducting pipes that span said pipe plates 1 and are attached to them by welds. 5 represents pipe support plates which are attached to the lengthwise-running plurality of heat conducting pipes 4 in several places and 6 represents reinforcing pipes which are firmly attached to the inside face of the foregoing pipe plates 1 at each end by flanges, etc., and which serve to strengthen the pipe plate unit 201 and to support the foregoing pipe support plate 5.

According to the present invention, junction area(s) 7 divide the pipe plate unit 201 that was described above in the horizontal direction perpendicular to the pipe plate at the parallel surfaces 07 into a set comprised of a plurality of subassembly units 100 (in FIG. 2 there are two, in FIG. 7, three), and these subassembly units are connected at junction area(s) 7.

In this embodiment, when assembling the foregoing plurality of subassembly units 100 as replacements into an existing condenser 200, the foregoing two sets of subassembly units 100 are fabricated in a factory, the subassembly units 100 are then transported to the plant where they are to be installed, and then the subassembly units 100 are attached together vertically in a manner to make them fluid-tight and adequately strong to thereby complete the swapping out of the pipe plate unit 201.

In this replacement operation, since the foregoing pipe plate unit 201 is divided into a plurality of subassembly units along a horizontal plane that is perpendicular to pipe plates 1, and further, since the subassembly units 100 are installed in succession, in (heat exchanger) installations found in condensers for thermoelectric or nuclear power plants, which lie below the floor grade 204, even in cases where it would be difficult to install the entire pipe plate unit 201 in an assembled form, it can be divided into these appropriately sized subassembly units 100 that can easily be moved horizontally and assembled in the device.

Thus, even in cases where it would be difficult to install in the condenser 200, the entire pipe plate unit 201 in an assembled form, it can be divided into these appropriately sized subassembly units 100 that can easily be moved horizontally and assembled in the device.

The above described structure eliminates the requirements imposed by the conventional technology when swapping out the pipe plate unit 201 of acquiring all of the necessary parts on site, inserting each of the heat conducting pipes 4 and welding them in place; as well as the need when replacing the pipe plate unit 201, of lifting the entire condenser to a position that avoids the interference by the foundation 205 with the pipe plate unit 201 and then replacing the unit. It not only simplifies the operation of replacing pipe plate units 201, but requires but few steps in performing the replacement.

Since the pipe plate unit that is to be replaced is waste, it can be easily cut into pieces for removal, and as such, a detailed description of that process has been omitted.

Figure 2:
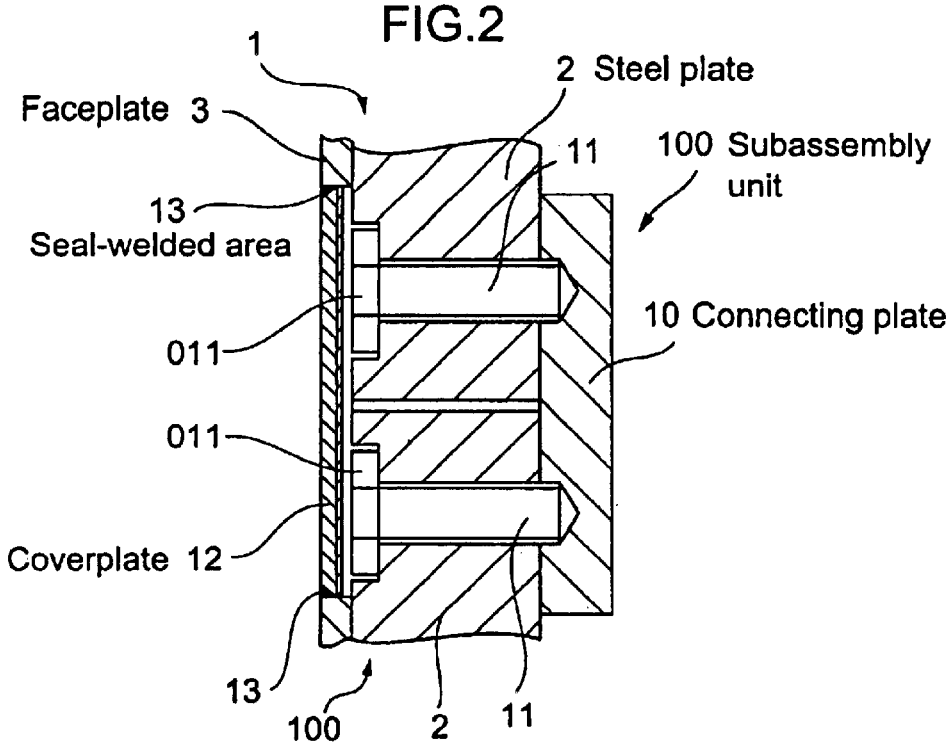
FIG. 2 is a sectional view (taken along line A—A of FIG. 1 (A)) of the primary parts of a of the connecting area of a first embodiment of a subassembly unit.
Figure 3:
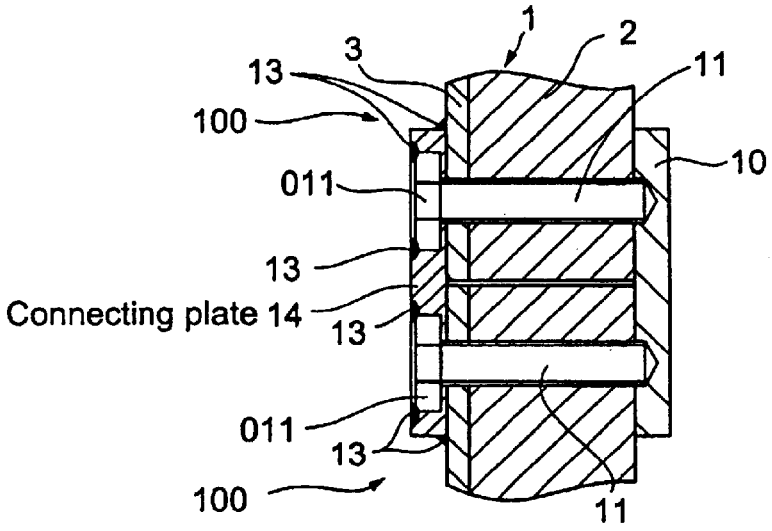
FIG. 3, which corresponds to FIG. 2, shows a second embodiment of the connecting area of a subassembly unit.
Figure 4:
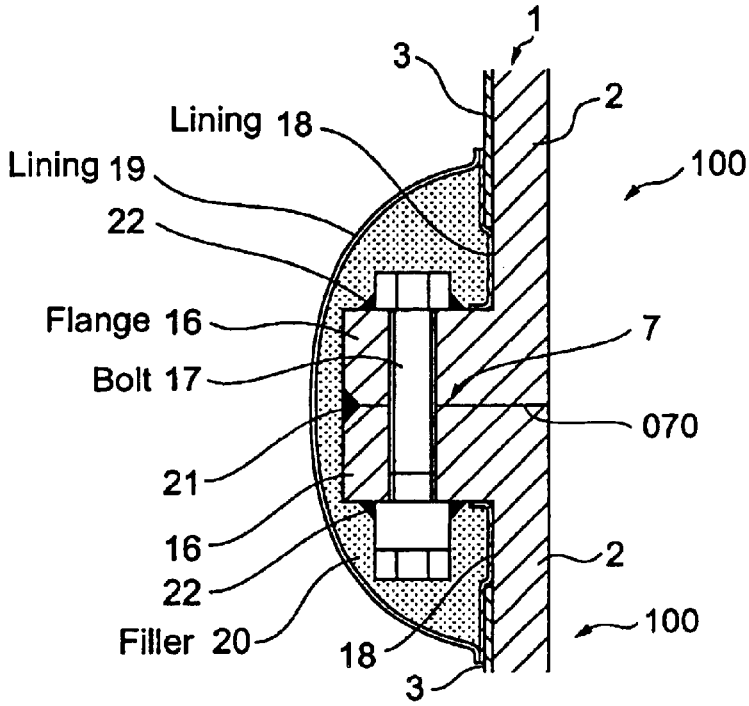
FIG. 4, which corresponds to FIG. 2, shows a third embodiment of the connecting area of a subassembly unit.
Figure 5:
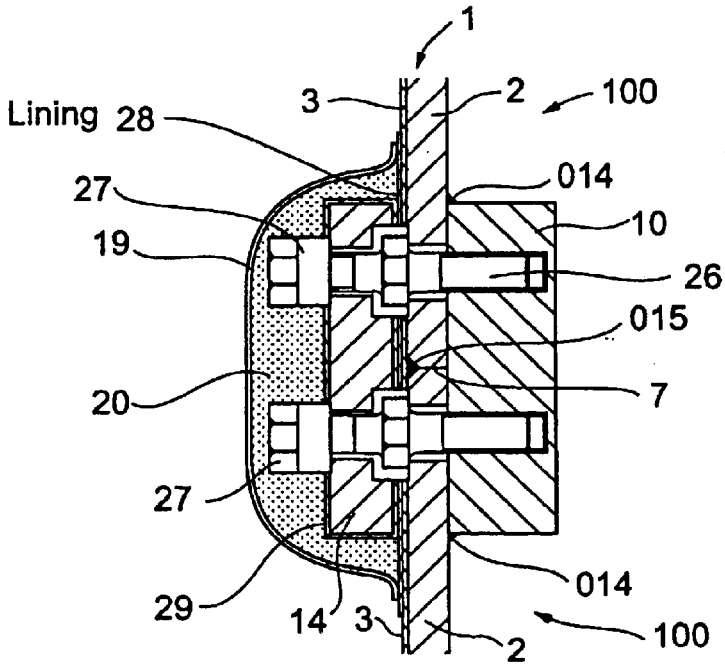
FIG. 5, which corresponds to FIG. 2, shows a fourth embodiment of the connecting area of a subassembly unit.
Figure 6:
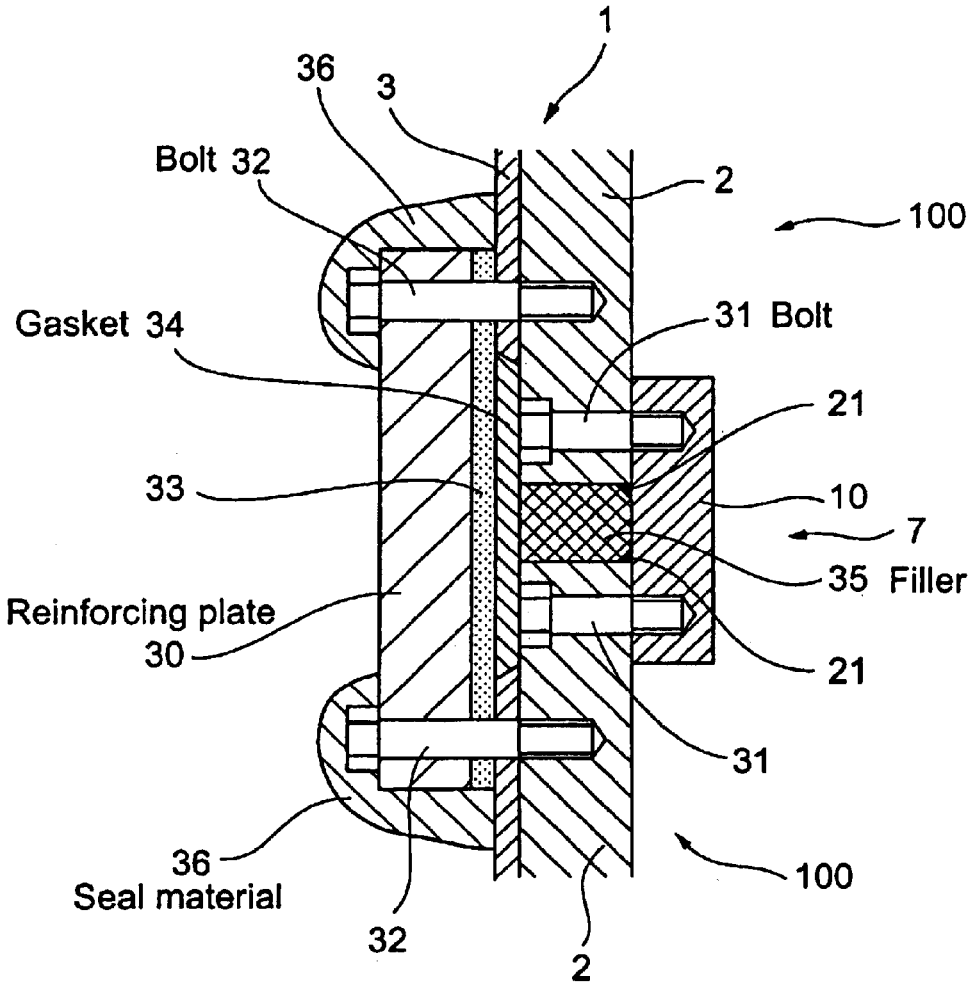
FIG. 6, which corresponds to FIG. 2, shows a fifth embodiment of the connecting area of a subassembly unit.
Figure 7:
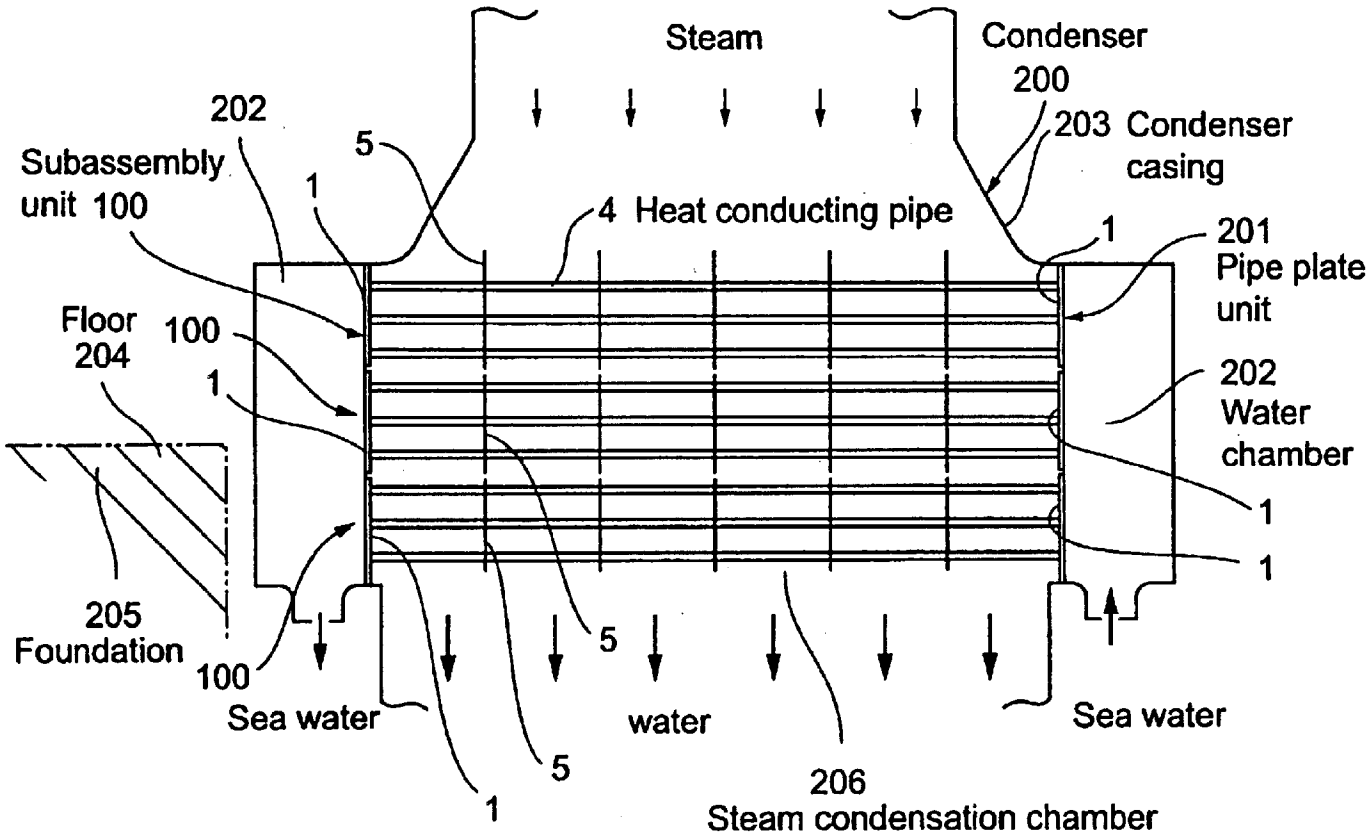
FIG. 7 shows a side view of a condenser for a thermoelectric or nuclear power plant which employs the present invention.
Figure 8:
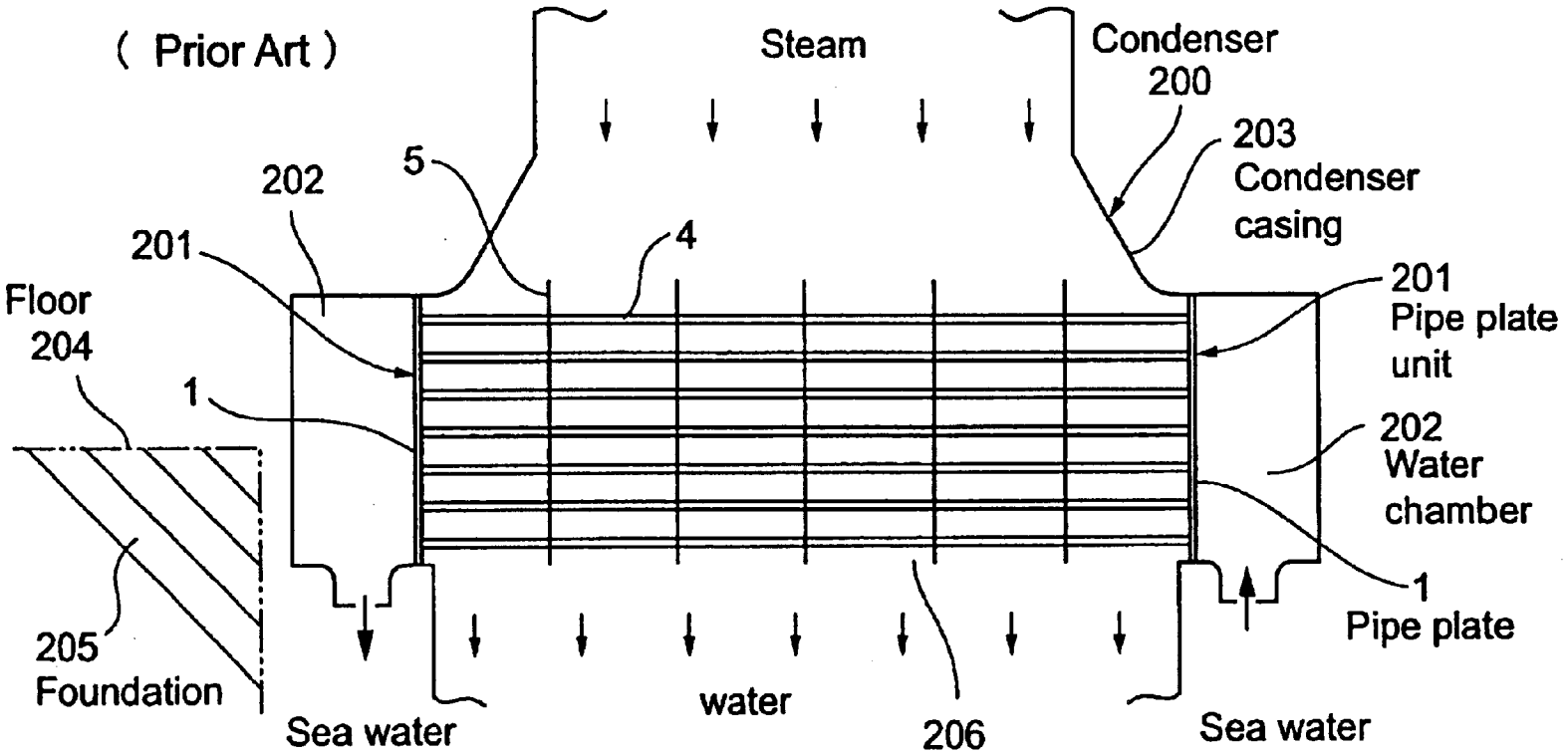
FIG.8 ( Prior Art )
FIG. 8 shows a side view of a condenser according to the first prior art.
Figure 9:
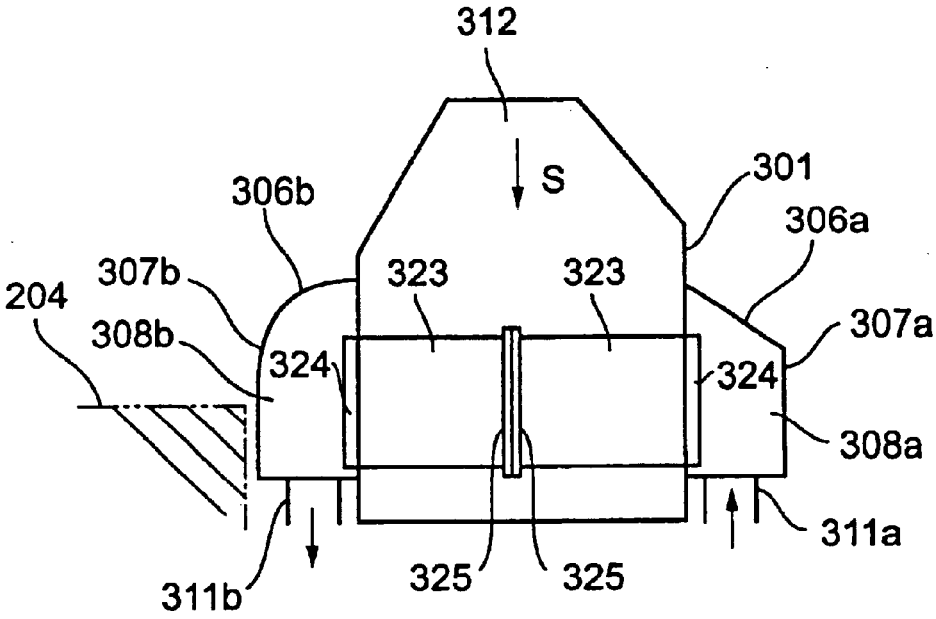
FIG.9 ( Prior Art )
FIG. 9 shows a side view of a condenser according to the second prior art.
Figure 10:
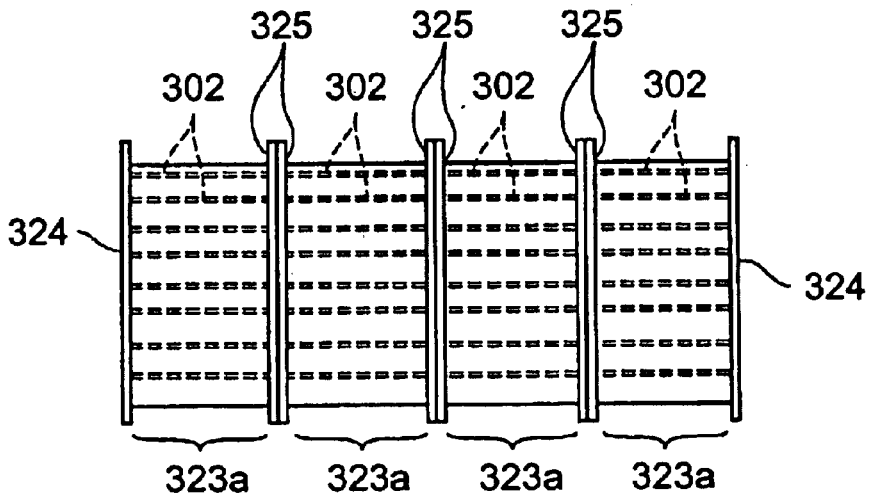
FIG.10 ( Prior Art )
FIG. 10 shows a side view of a pipe plate unit for a condenser according to the second prior art.

FIGS. 2 through 6 show sectional views, taken along line A—A of FIG. 1(A), of the first through fifth embodiments of the interconnection structure used at the junction areas of two adjacent subassembly units 100 in their connected state. In the following embodiments all of the affixing and seal welding for subassembly units 100 was performed at the installation site for pipe plate unit 201.

In the first embodiment of the junction area for the subassembly units depicted in FIG. 2, pipe plate 1 in the foregoing subassembly unit 100 is made of steel plate 2, which is clad on the side facing the foregoing water chamber 202 (see FIG. 7) with a titanium faceplate 3 by explosive cladding to create a clad steel plate structure.

The junction area 7 (see FIG. 1) between the foregoing subassembly units 100 on the side opposite faceplate 3 on the foregoing pipe plate 1, to wit, on the side of heat conducting pipes 4, is a connecting plate 10 pressed against and seal welded to said heat conducting pipe side of the foregoing steel plate 2 in a manner such that it spans across the foregoing subassembly units 100.

In addition, bolts 11, accommodated by boring through faceplate 3 to an appropriate depth, hold connecting plate 10 against the heat conducting pipe side of steel plate 2 of each subassembly unit 100. This structure provides a strong connection via the connecting plate 10 between each of the subassembly units on the foregoing heat conducting pipe side.

Further, the heads of the foregoing bolts 11 as well as the area of the faceplate 3 that was bored away are covered by a cover plate 12 made of titanium; said cover plate 12 is seal welded around its perimeter to the foregoing faceplate (13 is the seal-welded area).

According to this embodiment, the subassembly units 100 are strongly joined together by bolts 11 holding connecting plate 10 against the heat conducting pipe side to span across the adjacent subassembly units to thereby improve the flexure strength of the junction area 7. Further since the only seal welding was performed at the installation site of the foregoing condenser 200, there is almost none of the deformation or reduced strength that commonly results form welding.

Further, the seal welding was performed around cover plate 12 that covers the head area 011 of bolts 11 assures that no leakage will occur at the foregoing junction area 7.

Since both the heat conducting pipes and faceplates 3 are comprised of titanium materials, it is possible to weld the foregoing titanium cover plate 12 to faceplate 3 to avoid any possibility of galvanic corrosion between the titanium materials and steel plate 2.

In the second embodiment of the interconnection of the subassembly units shown in FIG. 3, the pipe plates 1 of the foregoing subassembly units 1 have a similar structure to that of the first embodiment, comprising steel plate 2 clad with a titanium faceplate 3 to create a clad steel plate.

The junction area 7 (see FIG. 1) between the foregoing subassembly units 100 also has a connecting plate 10 that spans across the foregoing subassembly units 100 on the heat conducting pipe side of the foregoing pipe plate 1 and which is seal welded to the foregoing steel plate 2 in a manner similar to the previous embodiment.

A connecting plate 14 additionally spans across on the foregoing faceplate side to result in connecting plates 14 and 10 both spanning adjacent subassembly units 100 on both sides of pipe plate 1. The two connecting plates 14 and 10 sandwich the foregoing two pipe plates 1, and bolts 11 secured against the foregoing connecting plate 14 that pass through pipe plate 1 hold connecting plate 10 against the heat conducting pipe side, to strongly attach the adjacent subassembly units' 100 pipe plates 1 together.

Furthermore, seal welding is performed around the perimeter of connecting plate 14 on the foregoing faceplate 3, as well as around the area of the bolt heads 011 against connecting plate 14.

Since the attached connecting plate 14 and the bolt 11 cover plate 3 are exposed to sea water inside water chamber 202, they are made from titanium materials.

According to the present embodiment, the foregoing connecting plates 14, 10 sandwich pipe plates 1 of the adjacent subassembly units 100 to hold them together, and bolts 11 firmly attach connecting plates 14 and 10 to the pipe plates 1 of the adjacent subassembly units to improve the flexure strength of the subassembly units at their junction 7.

Further, the use of titanium materials on the water chamber side and the seal welding of the seams prevent the possibilities of fluid leakage and galvanic corrosion.

In the third embodiment of the interconnection of the subassembly units shown in FIG. 4, the pipe plates 1 of the foregoing subassembly units 100 consist of steel plates 2 clad with a titanium faceplate 3 to comprise a clad steel plate structure.

At junction area 7 between the foregoing subassembly units 100, the foregoing faceplate 3 has been removed over a specific length from the junction surface 070 of the adjacent subassembly units 100. Flange 16 projects from the area of each pipe plate 1 where the faceplate 3 was removed, and bolt 17 tightly joins the flange surfaces 16 together; subsequently seal welding is used to seal in the required areas against fluid leakage, such as flange connection are and bolt connection area. 21 and 22 are the seal weld areas gainst such fluid leakage.

18 is a lining made from flexible materials, and it is attached over the foregoing faceplate 3 to span across the areas of the surface where faceplate 3 was removed to the surface of faceplate 3 where it is attached. Non-metallic filler material 20 covers foregoing lining 18 the outside surfaces of the bolt 17 connection area and flange 16. 19 is lining material consisting of a flexible membrane which covers the outside circumference of the foregoing filler 20 to shield it from the sea water in water chamber 202.

In the present embodiment, flanges 16 project at junction area 7 for the subassembly units 100, and bolt 17 securely holds said flanges 16 together to afford increased flexure strength to junction area 7 of subassembly units 100, as well as strongly joining said subassembly units 100 together. Seal welding is also performed at the foregoing flange 16 junction and around the bolt 17 in order to make them fluid tight to positively prevent fluid leakage at the foregoing junction area.

Further, a non-metallic filler material 20 is put in place around the foregoing flange 16 and bolt with its outside circumference covered by lining material 19 to completely isolate subassembly unit 100 from the sea water inside water chamber 202, and to prevent corrosion in the vicinity of junction area 7.

In the fourth embodiment of the interconnection of the subassembly units shown in FIG. 5, pipe plates 1 of the foregoing subassembly units 100 have a structure similar to those of the first embodiment wherein pipe plates 1 of subassembly units 100 are affixed together by steel plate 2 and a clad steel plate comprised of said steel plate 2 and a faceplate 3 made of titanium.

At junction area 7 between the foregoing subassembly units 100, connecting plate 10 spans across the foregoing pipe plates 1 on the heat conducting pipe 4 side between the adjacent subassembly units 100, and said connecting plate 10 is seal welded to one of the foregoing steel plates 2 (014 is the seal weld). Then, both threaded bolts (compound screw bolts) 26 fasten steel plate 2 and connecting plate 10. At this time, a part of the faceplate 3 had been removed previously to accommodate both bolts 26.

Next, a non-metallic film sheet 29 was used as a lining on the faceplate 3 side to span across connecting plate 14 and was fastened to connecting plate 14 with threaded bolts (compound screw bolts) 26 and button head nuts 27. The two bolts (compound screw bolts) 26 passing through the pipe plates 1 from the foregoing connecting plate 14 and nuts 27 secure the front and back connecting plates 14, 10 to solidly join the adjacent subassembly units 100 together.

Further, disposed between the outside surface of connecting plate 14 and the foregoing faceplate 3 is lining material 28, which is made from a flexible material. Further, the outside perimeter around the connecting plate 14 is covered with a flexible lining material 29 on the foregoing faceplate side.

Further, filler material 20 made of a non-metaric materials covers the outside surfaces of the foregoing bolts (compound screw bolts) 26, junction area 7 and lining material 28. The flexible film lining 19 in turn covers the outside circumference of the foregoing filler 20 to shield it from water chamber 202.

The structure of the present embodiment is such that the subassembly units are held by means of attaching the connecting plates 14, 10 at the top and bottom to the subassembly units 100 with bolts (compound screw bolts) 26 to provide a strong attachment of the subassembly with improved flexure strength at their junction. Further, on the faceplate side, since the connecting plate 14 and the titanium faceplate 3 are sealed at their attachment surface by lining materials 28, 29, the structure assuredly prevents any fluid leakage from junction area 7 of the subassembly units.

Further, the presence of the non-metallic filler 20 outside of the bolts which is covered by the flexible lining 19, completely shields junction area 7 of subassembly units 100 from the water chamber 202 to thereby prevent corrosion in the vicinity of said junction area 7.

In the fifth embodiment of the interconnection of the subassembly units shown in FIG. 6, the structure is similar to that of the first embodiment wherein pipe plates 1 of subassembly units 100 are affixed together by steel plate 2 and a clad steel plate comprised of said steel plate 2 and a faceplate 3 made of titanium.

In junction area 7 between the foregoing subassembly units 100 on the heat conducting pipe 4 side of the foregoing pipe plates 1, is a connecting plate 10 that spans across the adjacent subassembly units 100 on the heat conducting pipe side which is solidly attached to each subassembly unit 100 and steel plate 2 by bolts 31, and then seal welding is performed at the interface between the connecting plate 10 on the heat conducting pipe side and the subassembly units to fill the gap between them. (21 is the seal welded area.) Next, the space between the subassembly units is filled with a non-metallic filler material 35.

In addition, a reinforcing plate 30 that spans the adjacent subassembly units 100 on the faceplate side 3 of the foregoing pipe plate 1 is solidly affixed to the foregoing subassembly units 100 with two gaskets 33, 34 disposed between by means of a second set of bolts 32. 36 is seal material that covers the area around the heads of the second set of bolts 32.

In this embodiment, in addition to having bolts 31 attach connecting plate 10, which spans subassembly units 100, to subassembly units 100 on the heat conducting pipe side, a reinforcing plate 30 that spans the subassembly units 100 is attached on the faceplate 3 side. Since the reinforcing plate and the connecting plate which are attached on the back and front of the subassembly units 100 by means of independent bolt sets 31, 32, this configuration can greatly improve the strength of junction area 7 as well as improving its flexure strength.

Further, the attachment surfaces between reinforcing plate 30 and subassembly units 100 being each covered by gaskets 33, 34 serves to further improve the fluid seal at junction area 7 and assuredly protect against leakage from junction 7.

In this replacement operation according to this invention, since the foregoing pipe plate unit is divided into a plurality of subassembly units along a horizontal plane that is perpendicular to pipe plates, and further, since the subassembly units are installed in succession, in (heat exchanger) installations found in condensers for thermoelectric or nuclear power plants, which lie below the floor grade, even in cases where it would be difficult to install the entire pipe plate unit in an assembled form, it can be divided into these appropriately sized subassembly units, and assembled in the device easily.

The above described structure eliminates the requirements imposed by the conventional technology when swapping out the pipe plate unit of acquiring all of the necessary parts on site, but not in a factory, inserting each of the heat conducting pipes and welding them in place; as well as the need when replacing the pipe plate unit, of lifting the entire condenser to a position that avoids the interference by the foundation with the pipe plate unit and then replacing the unit. It not only simplifies the operation of replacing pipe plate units, but also requires but few steps in performing the replacement, and this can reduce the replacement cost.

According to this invention, the subassembly units are strongly joined together by bolts holding connecting plate to span across the adjacent subassembly units to thereby improve the flexure strength of the junction area. Further since the only seal welding was performed at the installation site of the foregoing condenser, there is almost none of the deformation or reduced strength that commonly results form welding. Further, the seal welding was performed around cover plate assures that no leakage will occur at the foregoing junction area.

Further when both the heat conducting pipes and faceplates are comprised of titanium materials, it is possible to weld the foregoing titanium cover plate to faceplate to avoid any possibility of galvanic corrosion between the titanium materials and steel plate.

According to the present invention, the foregoing connecting back and front plates sandwich pipe plates of the adjacent subassembly units to hold them together, and bolts firmly attach connecting plates to the pipe plates 1 of the adjacent subassembly units to improve the flexure strength of the subassembly units at their junction.

Further, in the present invention, flanges project at junction area for the subassembly units, and bolt securely holds said flanges together to afford increased flexure strength to junction area of subassembly units, as well as strongly joining said subassembly units together. Seal welding is also performed at the foregoing flange junction and around the bolt, this makes them fluid tight to positively prevent fluid leakage at the foregoing junction area.

Further, since a non-metallic filler material is put in place around the foregoing flange and bolt with its outside circumference covered by lining material, this configuration can completely isolate subassembly unit from the sea water inside water chamber, and to prevent corrosion in the vicinity of junction area.

Furthermore, since the structure of the present invention is such that the subassembly units are held by means of attaching the connecting plates to the subassembly units with bolts (compound screw bolts), it provides a strong attachment of the subassembly with improved flexure strength at their junction. Further, on the faceplate side, since the connecting plate 14 and the titanium faceplate 3 are sealed at their attachment surface by lining materials, the structure assuredly prevents any fluid leakage from junction area of the subassembly units.

Further, the presence of the non-metallic filler outside of the bolts which is covered by the flexible lining, completely shields junction area of subassembly units on the water chamber side to thereby prevent corrosion in the vicinity of said junction area.

In this invention, in addition to having bolts attach connecting plate, which spans subassembly units, to subassembly units on the heat conducting pipe side, a reinforcing plate that spans the subassembly units is attached on the faceplate side. Since the reinforcing plate and the connecting plate which are attached on the back and front of the subassembly units by means of independent bolt sets, this configuration can greatly improve the strength of junction area as well as improving its flexure strength.

Further, the attachment surfaces between reinforcing plate and subassembly units being each covered by gaskets serves to further improve the fluid seal at junction area and assuredly protect against leakage from junction.

What is claimed is:

1. A pipe plate unit for a heat exchanger to be provided between a pair of water jackets, comprising:

a pair of pipe plates;

a plurality of heat conducting pipes, the heat conducting pipes being arranged to each other and perpendicular to the pipe plates and fixed by welding to the pipe plates to be constructed as an assembly unit so that a plurality of the assembly units can be vertically arranged between the pair of water jackets to be attached to the pair of water jackets by the pair of pipe plates; and a plurality of support plates perpendicularly attached to said plurality of heat conducting pipes at several lengthwise locations, wherein each said pipe plate comprises a clad steel plate which comprises a steel plate and a faceplate cladding of titanium plate bordering a fluid chamber, a connecting plate at a connection area of said assembly units is provided on a side opposite a faceplate cladding side, and said connecting plate connects adjacent assembly units by bolts.

2. The pipe plate unit of claim 1, wherein a bolt insertion area including heads of said bolts are covered by a cover plate, and a perimeter of said cover plate is seal welded to said faceplate cladding.

3. The pipe plate unit of claim 1, wherein a pair of connecting plates sandwich said adjacent assembly units and connect by the bolts which penetrate said assembly units and said connecting plates, and further, a bolt insertion area including the connecting plates on a water chamber side, said bolts, and said faceplate cladding of titanium plate bordering said fluid chamber are seal welded to each other.

4. The pipe plate unit of claim 1, wherein said bolts are compound screw bolts, and a first connecting plate connects said adjacent assembly units by one of said compound screw bolts, and further, a second connecting plate covered by a lining made from a non-metallic membrane material on the faceplate cladding side connects said adjacent assembly units by said compound screw bolts and nuts.

5. The pipe plate unit of claim 4, wherein a filler made from non-metallic materials is applied to cover outside areas of said second connecting plate provided on the faceplate cladding side and an outer side of said compound screw bolts, and an outside circumference of said filler is further covered by a lining made from a non-metallic membrane material.

6. The pipe plate unit of claim 1, wherein a reinforcing plate at a connection area of said assembly units is provided on the faceplate cladding side of said pipe plates, and said reinforcing plate connects said adjacent assembly units by second bolts via gaskets.

7. The pipe plate unit of claim 6, wherein a space is created between said adjacent assembly units, and said space is filled with a filler made from non-metallic materials.

* * * * *